United States Patent [19]

Ishii et al.

[11] Patent Number: 4,650,527

[45] Date of Patent: Mar. 17, 1987

[54] HYDROPHILIC SURFACE-TREATING PROCESS FOR AN ALUMINUM ARTICLE

[75] Inventors: Tooru Ishii; Masashi Isobe, both of Shizuoka, Japan

[73] Assignee: Nippon Light Metal Company Limited, Tokyo, Japan

[21] Appl. No.: 848,350

[22] Filed: Apr. 4, 1986

Related U.S. Application Data

[63] Continuation of Ser. No. 638,560, Aug. 7, 1984, abandoned.

[30] Foreign Application Priority Data

Aug. 12, 1983 [JP] Japan ..... 58-146638

[51] Int. Cl.[4] ..... C23C 22/37; C23C 22/38

[52] U.S. Cl. ..... 148/6.16; 148/6.2

[58] Field of Search ..... 148/6.2, 6.16, 6.27

[56] References Cited

U.S. PATENT DOCUMENTS

| | | | |
|---|---|---|---|
| 3,506,499 | 4/1970 | Okada | 148/6.2 |
| 4,137,368 | 1/1979 | Miller | 148/6.2 |
| 4,462,842 | 7/1984 | Uchiyma | 148/6.2 |

FOREIGN PATENT DOCUMENTS

| | | | |
|---|---|---|---|
| 0169092 | 10/1982 | Japan | 148/6.2 |
| 0189377 | 11/1983 | Japan . | |
| 0016981 | 1/1984 | Japan | 148/6.2 |

*Primary Examiner*—Sam Silverberg

*Attorney, Agent, or Firm*—William J. Daniel

[57] ABSTRACT

The invention involves a nonrinse type hydrophilic surface-treating process capable of imparting hydrophilicity to the surface of a metal material, e.g., aluminum, and, at the same time, forming thereon a coating excelling in resistance to corrosion. In the process there is applied an aqueous solution which contains selected amounts of Cr ions (III, VI), $F^-$, $SiO_2$ and a water-soluble acrylic acid polymer, and optionally $PO_4^{-3}$, if necessary. An aluminum article treated by this process is suitable for the fins of a heat exchanger.

12 Claims, No Drawings

HYDROPHILIC SURFACE-TREATING PROCESS FOR AN ALUMINUM ARTICLE

This application is a continuation of application Ser. No. 638,560, filed Aug. 7, 1984, now abandoned.

BACKGROUND OF THE INVENTION

1. Field of the Invention

This invention relates to a nonrinse type hydrophilic surface-treating process capable of imparting hydrophilicity to the surface of a metal material and, at the same time, forming thereon a coating excelling in resistance to corrosion (hereinafter referred to as "surface-treating process") and to the aluminum article treated with the surface-treating process.

2. Description of Prior Art

Metal materials, particularly aluminum metal and alloys, find extensive utility in numerous applications. In some applications, they are required to possess a surface that is readily wettable with water but is corrosion-resistant. In the case of a metal material used in fins for a heat exchanger, for example, an increasingly large number of functional requirements must be satisfied such as prevention of rusting, improvement is efficiency of energy consumption, and abatement of noise. The recent trend of heat exchangers toward improved performance combined with reduction in size has prompted a gradual reduction of fin interval or spacing. A heat exchanger relies on the surface of fins for exchange of heat between a heat or coolant medium circulated within and the ambient air without. When using the heat exchanger for space cooling, the moisture in the atmospheric air condenses on the surface of the fins. When the fin interval is reduced to less than 3 to 4 mm, the water condensate gathers into droplets and bridges the gaps between the adjacent fins. These water droplets offer increased resistance to currents of air, generate noise, impair efficient heat transfer and increase energy consumption. Consequently, it is desirable for the fins to possess a hydrophilic surface.

In addition to heat exchangers, the surfaces of other articles are desired to be protected against the formation of dew in a humid atmosphere, while other metal surfaces are required to remain glossy and, therefore, are expected to be free of clouding, and still other metal surfaces are desired to have a high affinity for water and aid in accelerating the evaporation of adhering water. To fulfil these requirements, the practice of providing hydrophilic coatings for such metal surfaces is common. The desirability of a more effective hydrophilic surface-treating process, therefore, is finding growing recognition.

Known methods available for providing hydrophilic surfaces for aluminum articles include, for example, (1) a process which resorts to treatment with beohmite, (2) a process which relies on treatment with chrome-phosphate claimed to produce a chromate coating of relatively high hydrophilicity than other forms of chromate, and (3) a process which consists in applying a hydrophiic paint. As shown in Table 1, these methods have defects of their own and cannot be considered an adequate solution.

TABLE 1

| | | Treatment with boehmite | Treatment with chrome-phosphate | Hydrophilic paint | |
|---|---|---|---|---|---|
| | | | | Surfactant type | Silica type |
| Wettability | Initial stage of use after treatment | O | O | O | O |
| | Durability in protracted service | O | X | X | O |
| Corrosion resistance | Test by exposure to moisture | X | O | X | Δ |
| Press moldability (drawless type) | | Δ | O | O | X |
| Problems | | Prolonged treatment required. Bath control is difficult. Poor corrosion resistance. | Waste chromate solution threatens water pollution. | extra step for undercoating is required for ensuring desired adhesion of paint. | |

Note:
In the table, the test results are rated by the three-point scale, wherein O denotes satisfactory performance, Δ partially inferior performance, and X totally inferior performance. The same scale is used in Table 2 to follow.

Another known process for hydrophilic treatment uses a chromate bath incorporating therein a water-soluble type polyacrylic acid resin. The coating formed by this process is intended as an undercoat and, therefore, is deficient in hydrophilicity and corrosion-resistance. If to enable this coating to be used as a regular surface coating, either of these known processes were modified to incorporate such generally known expedient as adding silica powder to the bath thereby enhancing the hydrophilicity of the resultant coating or increasing the hexavalent chromium ion concentration in the chromate bath thereby imparting improved corrosion resistance to the produced coating, the problem still would not be solved. When the silica powder is added to the conventional bath, it must be added in a generous amount to obtain the desired enhancement of the hydrophilicity. As the result, the density or coherency of the inorganic coating is impaired and the stability of the coating to resist corrosion is degraded. If the hexavalent chromium ion concentration is raised as a compensatory measure, then there ensues a disadvantage that the produced coating while in use exudes excess hexavalent chromium ion. Thus, the desired improvement of the coating properties cannot be obtained by simply applying the aforementioned means to the conventional bath used in its unaltered form.

SUMMARY OF THE INVENTION

The inventors, after continuing to search for a surface-treating process capable of imparting enhanced hydrophilicity and outstanding corrosion resistance to the surface of a metal article, have found that the combination of properties is obtained in accordance with this invention by a precise combination of chromium compounds, acrylic acid polymer, silica, hydrofluoric acid, and optionally phosphoric acid.

An object of this invention is to provide a hydrophilic surface-treating process which imparts enhanced hydrophilicity and excellent corrosion resistance to the surface of a metal article, particularly an article of aluminum metal or alloy.

Another object of this invention is to provide an aluminum article treated with the hydrophilic surface-treating process described above.

Other objects and characteristics of this invention will become apparent from the further disclosure of this invention to be made in the following detailed description of a preferred embodiment.

DETAILED DESCRIPTION OF THE INVENTION

This invention is directed to a non-rinse type hydrophilic surface-treating process, comprising steps of applying to a metal surface a hydrophilic surface-treating bath which comprises an aqueous solution which contains 1 to 20 g, as $CrO_3$, of a mixture of trivalent and hexavalent chromium compounds, of which 0.05 to 2 g, as $CrO_3$, provides hexavalent chromium ions, 1 to 20 g/as solids, of acrylic acid polyer, 0.1 to 5 g, as $F^-$, of a fluoride, 1 to 100 g of silica, and respectively per liter thereof, the weight ratio of the silica to the total weight of the acrylic acid polymer+chromium compounds (calculated as $CrO_3$)+silica being between 0.3:1 and 0.8:1; drying; and then heating at 100° to 250° C. for a period of 10 seconds to 30 minutes.

The surface-treating bath used in this invention, when necessary for the purpose of prolonging the affinity of the treated metal surface for water for a long time, may additionally incorporate therein 0.1 to 100 g, as $PO_4^{-3}$, of phosphoric acid per liter.

Now, the components to be used for the composition of the surface-treating agent used in this invention will be described. Examples of trivalent chromium compound include chromium hydroxide, chromium nitrate, chromium sulfate, chromium acetate, and chromium maleate. These compounds may be used either independently or in various combinations of two or more members. Examples of hexavalent chromium compounds include chromic acid ($CrO_3$), ammonium chromate, and dichromates represented by ammonium dichromate. The trivalent chromium compound is used in the form of any of the compounds enumerated above. By contrast, the hexavalent chromium compound such as, for example, $CrO_3$ may be used in partially reduced form with such an organic reducing agent as formaline, phenol, or polyhydric alcohol and any such partially reduced form can form part of the amount of the trivalent compound. In this case, the amount of separate trivalent chromium compound present is made smaller. The total chromium compound concentration in the surface-treating agent is requred to fall in the range of 1 to 20 g, preferably 2.5 to 12 g, as $CrO_3$, per liter of the bath. If this concentration is less than 1 g/liter, the surface-treating agent fails to give sufficient corrosion resistance to the metal surface and the acrylic acid polymer is not crosslinked to a satisfactory extent. If the concentration exceeds 20 g/liter, the treated metal surface assumes a color and induces local concentration of chromium, and the produced coating suffers from lack of uniformity. Moreover, the formation of a coating of excessive thickness is uneconomical. For the resultant coating to enjoy enhanced corrosion resistance, the surface-treating agent is required to contain hexavalent chromium ions in an amount of 0.05 to 2 g, preferably 0.2 to 1.5 g, expressed as $CrO_3$, per liter. If the hexavalent chromium ion concentration in the bath exceeds 2 g/liter, the resultant coating tends to exude excess chromium and give rise to possibly environmental pollution.

For use in the surface-treating bath of this invention, the acrylic acid polymer (hereinafter referred to as "resin") is required to be soluble in water. Examples of the resin include those water-soluble resins which are obtained by homopolymerization or copolymerization of such compounds as acrylic acid, methyl acrylate, ethyl acrylate, isopropyl acrylate, n-butyl acrylate, 2-ethyl acrylate, methacrylic acid, methyl methacrylate, ethyl methacrylate, isopropyl methacrylate, n-butyl methacrylate, isobutyl methacrylate, maleic acid, and itaconic acid. During subsequent heat treatment performed at a relatively low temperature for a short period of time, the resin is required to be insolubilized in water by undergoing a chelating reaction with a metal species of the valency of at least 2 contained in the surface-treating bath (chromium ion in the case of this invention). The resin should have an average molecular weight in the range of 10,000 to 300,000. Examples of resins of this description available in the market include such products of Rohm and Haas Co. which are marketed under trademark designations ACRYSOL A-1, A-3, and A-5. The amount of the resin to be included in the surface-treating agent is 1 to 20 g, preferably 4 to 14 g, as dry solids, per liter of the bath. If the concentration of this resin in the surface-treating agent is less than 1 g/liter, the bath fails to exhibit a sufficient film-forming property. If the concentration exceeds 20 g/liter, the bath of the surface-treating agent suffers from loss of stability. The insolubilization of the water-soluble resin in the present invention results from the formation of a sparingly soluble organic chromate compound by the cross-linking reaction of the resin with ions released by the aforementioned coexisting chromate compounds. Ample supply of the chromium required for this cross-linking reaction is attained by incorporating in the surface-coating either Cr (III) or Cr (VI) in an amount providing an excess over that consumed of not less than 0.2%, as $CrO_3$, based on the amount of the water-soluble resin. When the chromium compound is contained in the surface-treating agent as specified by this invention, therefore, the amount of the resin may be substantially changed as desired. It is, of course, permissible to impart enhanced corrosion resistance to the produced coating by using a thermosetting type water-soluble resin.

Examples of the fluoride to be used in the composition of the surface-treating agent include hydrofluoric acid and soluble salts of fluoric acid such as silicon fluoride, boron fluoride, titanium fluoride, zirconium fluoride, and zinc fluoride. Such a fluoride is used in an amount of 0.1 to 5 g, preferably 0.3 to 3.5 g, as F, per liter of the surface-treating bath. If the fluoride concentration (as $F^-$) in the surface-treating bath is less than 0.1 g/liter, the coating which is formed preponderantly of the reaction product of the metal of the substrate with the chromium compound does not acquire satisfactory corrosion resistance. If the concentration exceeds 5 g/liter, the metal of the substrate dissolves out and the fluoride strongly reacts with silica during the course of the treatment so that the surface-treating bath is controlled with difficulty. Then, the coating of desired properties cannot be easily obtained. Among other fluorides, hydrofluoric acid is used most advantageously. The mechanism underlying the manifestation of the effect of the addition of the fluoride has not been fully elucidated. A logical explanation of this effect is offered by the postulate that the fluoride acts on the metal of the substrate in cooperation with the chromium compound and, at the same time, exerts a dissolving action slightly on silica and causes silica particles to be finely dispersed within the resin, thus aiding in the formation of a coating which enjoys high density and ample toughness and abounds with hydrophilicity and corrosion resistance.

Optionally, the surface-treating agent used in this invention may additionally incorporate a phosphoric acid. Examples of the phosphoric acid advantageously usable for this purpose include orthophosphoric acid, pyrophosphoric acid, polyphosphoric acid, methaphosphoric acid, and phosphorous acid. When an alkali salt of any of the phosphoric acids enumerated above is used alone or in combination with any of the phosphoric acids, the amount of the alkali salt must be notably decreased. Any of the aforementioned phosphoric acids is used in an amount of 0.1 to 100 g, as $PO_4^{-3}$, preferably 0.5 to 10 g specifically in the case of orthophosphoric acid or 5 to 10 g specifically in the case of any other phosphoric acid than orthophosphoric acid, respectively per liter of the surface-treating agent. If the phosphoric acid concentration in the surface-treating agent is less than 0.1 g/liter, the affinity for water imparted to the resultant coating is limited. Although the coating thus obtained is sufficiently effective under mild working conditions, it fails to retain high affinity for water for a long time under harsh working conditions. If this concentration exceeds 10 g/liter, the corrosion resistance is slightly degraded while the affinity for water is high. This trend is definitely conspicuous when the concentration exceeds 100 g/liter.

For the surface-treating bath of this invention, silica is used in the form of powder or suspension. Specifically, fumed silica or water-containing amorphous silicic acid obtained by the wet process is available. Commercially available silica products include the product of Cabot Co. marketed under the trademark designation of CAB-O-SIL and the product of Shionogi & Co., Ltd. marketed under the trademark designation of CARPLEX. From the standpoint of uniform affinity for water, film-forming property, and corrosion resistance of the coating, both primary and secondary particles of silica are preferably as small as possible. The average particle diameter is desired to be not more than 1 μm. Particularly, in the case of primary particles, at least 50% of the particles are desired to have diameters not exceeding 1 μm. Although the amount of silica to be added varies with the amounts of chromium compound and resin to be used, it falls generally in the range of 1 to 100 g/liter, preferably in the range of 5 to 30 g/liter. If the silica concentration in the surface-treating bath is less than 1 g/liter, the produced coating fails to acquire desired affinity for water. If the concentration exceeds 100 g/liter, the produced coating is covered with adhering powder. The weight ratio of silica to the total weight of resin+chromium compound (as $CrO_3$)+silica is desired to fall in the range of 0.3:1 to 0.8:1, preferably 0.35:1 to 0.65:1. If this weight ratio is less than 0.3:1, the coating fails to acquire lasting affinity for water. If the weight ratio exceeds 0.8:1, the coating is covered with adhering powder. The silica component is preferably precoated with the resin. In this state, the silica component can be uniformly dispersed and the reaction of the silica with the hydrofluoric acid is allowed to be suitably controlled. Further, during the formation of the coating on the metal substrate, the silica component tends to collect preferentially in the surface stratum of the coating.

The preparation of the surface-treating both of this invention can be accomplished by various method such as, for example, separately preparing Bath A having silica powder uniformly dispersed in a resin solution and Bath B having the chromium compounds, a fluoride, and/or phosphoric acid mixed and dissolved in water and mixing the two baths immediately before actual use; or uniformly dispersing silica powder in a resin solution and adding the resultant dispersion to a trivalent chromium solution to prepare Bath A', mixing a fluoride with hexavalent chromium and/or phosphoric acid to prepare Bath B', and mixing the two baths immediately before actual use; or mixing all the components all at once immediately before actual use.

The surface-treating bath of this invention, as is usually with any other similar coating bath, can be applied continuously or batchwise on the metal surface by any suitable method such as, for example, spreading with a roll, spreading with a brush, immersion, or spraying. At a liquid temperature of 20° to 40° C., this bath is applied on the metal surface in a ratio of 20 to 40 ml/m$^2$, which is variable with its viscosity, (equivalent to 0.03 to 2.0 g/m$^2$ on dry basis) and then heated at 100° C. to 250° C. for a period of 10 seconds to 30 minutes. By the heat treatment, the resin in the agent is insolubilized and the applied layer of the agent on the metal surface is converted into a coating abounding with hydrophilicity and corrosion resistance. When the surface-treating bath of this invention is applied on the metal surface which has previously undergone a heat treatment and which is now in the process of being cooled, then the residual heat of the metal surface can be utilized for the curing of the applied surface-treating bath. This method permits a saving in energy cost. Until the applied layer of this bath has been insolubilized, this surface-treating bath may be applied repeatedly to increase the thickness of the coating. Within the range of composition of the surface-treating bath contemplated by this invention, a bath consisting of chromium compounds and a fluoride and a bath consisting of a resin, silica, and/or phosphoric acid may be separately prepared and these baths may be mixed directly on the metal surface by simultaneously spraying onto the metal surface. The application of the surface-treating bath is not always required to take place after the metal substrate has been molded in a given shape. Since the produced coating excels in press moldability, the coating may be formed first on the metal substrate and then the metal substrate subjected to the molding.

The thickness of the coating may be suitably selected to suit a given need. The coating formed in a thickness of the order of 0.1 μm (on dry basis) imparts hydrophilicity and corrosion resistance at the high levels required for the fins in a heat exchanger. Where corrosion resistance is particularly sought, the proportion of chromium compounds may be increased in the bath of the surface-coating. Where more emphasis is placed on hydrophilicity, the proportion of silica may be increased in the bath besides additional incorporation of phosphoric acid. In this manner, the coating properties can be adjusted without any change in the thickness of coating.

In the coating which is formed by applying the surface-treating bath as described above on the surface of an aluminum substrate, for example, a very thin inner layer or stratum such as of aluminum fluoride or aluminum silicofluoride is formed along the boundary between the coating and the aluminum substrate, then an intermediate layer of inoroganic substances including chromium compounds and silica is formed thereon in a relatively large thickness, and a third exterior layer of resin containing silica in a higher concentration than in the intermediate layer is formed in the surface zone. The surface layer serves to inhibit exudation of inorganic components, particularly chromium compounds, from the intermediate layer. Unlike the coating formed by conventional hydrophilic paint which has its corrosion resistance affected by the kind of paint, the thickness of the coating, the kinds and amounts of additives relative to the resin component, the coating formed of the surface-treating bath used in this invention has its corrosion resistance exclusively determined substantially by the inorganic substances. At least from the standpoint of corrosion resistance, therefore, there is nothing critical about the thickness of the layer of resin or the amount of silica component incorporated therein. Thus, the surface-treating bath used in this invention allows for much wider freedom of selection of the extent of hydrophilicity to be imparted to the treated metal surface and, therefore, can produce a coating of higher hydrophilicity than the conventional hydrophilic paint. The superiority of the coating of this invention in hydrophilicity may be logically explained by the postulate that the fluoride incorporated in the composition of the surface-treating agent acts in a peculiar way such that, in the layer formed along the boundary between the coating and the metal substrate, the fluoride combines itself with the metal of substrate, that the silica particles have their surface activity greatly enhanced by the fluoride enough to be bound more powerfully with the resin, that the outermost layer has its properties improved by the fluoride, and that the overall properties of the entire coating are notably improved as the result. The coating thus formed shows satisfactory performance when tested for moisture resistance and proves high in corrosion resistance and press moldability as well. These outstanding effects of the coating are never obtained when, in formulating the surface-treating bath, another inorganic acid such as, for example, sulfuric acid, hydrochloric acid, or nitric acid or such an organic acid as acetic acid is used in the place of a fluoride, particularly hydrofluoric acid.

Phosphoric acid, if used at all, is distributed preponderantly in the surface layer and partly in the intermediate layer and consequently allowed to act on the —COOH group of the acrylic acid polymer particularly in the surface layer, possibly enabling the coating to enjoy lasting hydrophilicity.

The hydrophilic surface-treating agent of this invention and a conventional hydrophilic paint are compared in Table 2 below.

TABLE 2

| | Hydrophilic paint (comparison) | Surface-treating process of this invention (I) | Surface-treating process this invention (II) |
|---|---|---|---|
| Bath composition | Resin + silica (surfactant) | Acrylic acid polymer + silica + chromium compounds + fluoride | Same as left, plus phosphoric acid |
| Amount of silica | Limited so as not to impair corrosion resistance of coating | Allowed to be increased so much as to impart required hydrophilicity. | Same as left. |
| pH value | Neutral - weakly alkaline | 1 to 3 | 1 to 3 |
| Method of treatment | | | |
| Pretreatment | Indispensable | Not necessary | Same as left. |
| Method of application | Immersion, spreading with roll, or spraying | Same as left. | Same as left. |
| Method of insolubilization of coating | Cross-linking between resin particles or removal of solvent. | Cross-linking by chelating reaction between carboxyl group of acrylic acid polymer and metal (chromium) | Same as left. |
| Construction of formed of coating | Uniform distribution of silica in layer of resin. | Surface layer rich in resin and silica intermediate layer containing chromium compounds, oxides, and silica, and bottom layer of metal of substrate and fluoride formed along the boundary between the coating and the metal substrate. | Same as left, except that the surface layer contains phosphoric acid besides resin and silica. |
| Total coating thickness | At least 1 μm | Up to 2 μm | Same as left. |
| Thickness of resin layer | Same as above | Up to 1.5 μm | Same as left. |
| Physical properties | | | |
| Wettability with water*1 | O | O | O |
| Corrosion resistance*2 | X | O | O |
| Press moldability | X | Δ~O | Δ~O |

Note
*1Determined by angle of contact and immersion in water bath.
*2Test for moisture resistance As described above, this invention uses a non-rinse type hydrophilic surface-treating bath which incorporates chromium compounds, acrylic acid polymer, fluoride and/or phosphoric acid, and silica in specific proportions, with the weight ratio of silica to the total of other components rigidly defined. When this surface-treating agent is applied on the surface of metal substrate such as aluminum, it can be advantageously applied by any ordinary method to produce a coating which abounds with hydrophilicity, excels in corrosion resistance, and exhibits outstanding press moldability. The coating thus formed also has an excellent effect of inhibiting exudation of the hexavalent chromium from the coating.

Now, the present invention will be described more specifically below with reference to working examples.

Example 1

(1) Preparation of hydrophilic metal surface-treating bath

An aqueous solution (Bath A) containing chromium nitrate ($Cr(NO_3)_3.9H_2O$) as $Cr^{+3}$, chromium trioxide as $Cr^{+6}$, hydrofluoric acid (46% HF) as $F^-$, and orthophosphoric acid (100% $H_3PO_4$) as $PO_4^{-3}$ and a solution (Bath B) having silica powder of an average primary particle diameter of 0.01 μm (product of Cabot Co. and marketed under trademark designation of CAB-O-SIL) uniformly dispersed in an aqueous 25 wt% polyacrylic acid solution (product, having a molecular weight of not more than 50,000, of Rohm and Haas Co. and marketed under trademark designation of Acrysol A-1) were prepared. Bath B and Bath A were mixed in proportions such as to give compositions of varying concentrations shown in Table 3.

(2) Surface treatment and results

An aluminum sheet (AA3102, measuring 100 mm×100 mm×0.15 mm in thickness) was degreased by an ordinary pretreatment. The surface-treating agent formulated in (1) was applied by a roll coating method on the surface of the aluminum sheet in a ratio of about 25 ml/m$^2$. The coated aluminum sheet was dried in a hot air oven at 130° C. for 10 minutes to insolubilize the coating.

The test piece thus obtained was tested for affinity for water by a water immersion method which comprises immersing a given test piece in a deionized water, removing the test piece from the water and allowing it to stand for about 30 seconds, measuring the area of wet surface of the test piece, and reporting the found value as representing the affinity for water. Then, the test piece was tested for lasting affinity for water by being subjected to cooling and heating cycles for 16 hours and 96 hours. It was then tested for corrosion resistance which was rated in terms of the area of corroded surface after 250 hours' and 500 hours' standing in a humid atmosphere. The results are shown in Table 3.

The test pieces, No. 4, 7, 12, 15, and 16, which contained no orthophosphoric acid showed slightly inferior durability. Since the testing method was extremely severe, it may be safely concluded that test pieces showing protection of 70 to 80% after 16 hours' test provide sufficient durability under normal working conditions of heat exchangers. The other test pieces which contained orthophosphoric acid, except for No. 14, gave quite satisfactory results. They are usable in automotive heat exchangers which are destined to extremely harsh working conditions. Test piece, No. 14, due to the absence of $F^-$ ions suffered corrosion on the metal substrate and could not be tested for affinity for water.

The test piece, No. 4, contained no $Cr^{+6}$ and, therefore, suffered slight corrosion on the substrate metal because of the poor ability to inhibit corrosion. The test pieces, No. 6, 7, and 16, contained excessive amounts of $Cr^{+6}$ and, therefore, suffered exudation of $Cr^{+6}$ from the coatings and threatened a problem of environmental pollution. The test piece, No. 8, showed insufficient corrosion resistance because it contained Cr compounds insufficiently. The thickness of coating after 10 minutes' heating at 130° C. was about 0.5 μm in No. 5, about 0.3 μm in No. 2, about 0.8 μm in Nos. 3, 15, and 16, and about 0.4 to 0.5 μm in the other test pieces.

EXAMPLE 2

An aqueous solution (Bath A') containing chromium sulfate ($Cr_2(SO_4)_3.7H_2O$) and ortho-phosphoric acid in addition to the same polyacrylic acid and silica powder as used in Example 1 and a solution (bath B') resulting from the mixing of hydrofluoric acid with chromium trioxide were prepared. Bath A' and Bath B' were mixed by stirring in proportions such as to give surface-treating agents of varying compositions shown in Table 4. The agents were examined for effect of the addition of orthophosphoric acid.

In the test pieces, No. 17–22, the thickness of coating was about 0.7 μm. In the other test pieces, the thickness increased within the increasing amount of orthophosphoric acid. The effect of the added phosphoric acid was amply conspicuous up to about 0.1 g/liter of phosphoric acid concentration. The results of the test under the humid atmosphere was satisfactory up to about 10 g/liter of phosphoric acid concentration. The results indicate that such high phosphoric acid concentration as about 100 g/liter is tolerable unless the coated metal surface is exposed to a corrosive atmosphere.

EXAMPLE 3

Surface-treating agents were prepared by following the procedure of Example 2, except for the kind of phosphoric acid incorporated. With phosphoric acid of other form, the effect of the addition of phosphoric acid was poorer than that of the addition of orthophosphoric acid up to about 1 g/liter of phosphoric concentration. The results are shown in Table 5. The results indicate that such other phosphoric acid must be added in a concentration of about 5 g/liter to manifest the expected effect.

EXAMPLE 4

The effects of sodium salts of varying species of phsphoric acid were tested. Sufficient affinity for water was manifested when the concentration increased to about 5 g/liter. The results of the test under a humid atmosphere were degraded when the concentration reached 5 g/liter. The aggravation was conspicuous in the case of monosodium phosphate. The results given in Table 6 indicated that no sodium salt of phosphoric acid should be used unless in a very small amount.

TABLE 3

| Test piece No. | Amount of chromium (as $CrO_3$) Cr (III) g/l | Cr (VI) g/l | Acrylic acid polymer (as solids) g/l | Silica*1 g/l | Ratio of silica*5 | Fluorine ion (as $F^-$) g/l | Ortho-phosphoric acid (as $PO_4^{-3}$) g/l | pH of bath | Affinity for water: Before test*2 | After 16 hours' standing*3 | After 96 hours' standing*3 | Test under humid atmosphere*4: After 250 hours' standing | After 500 hours' standing |
|---|---|---|---|---|---|---|---|---|---|---|---|---|---|
| 1 | 1.92 | 1.42 | 8 | 8 | 0.41 | 1.0 | 1.0 | 1.8 | 100% | 100% | 100% | 0% | 0% |
| 2 | " | " | 4 | 4 | 0.35 | " | " | 1.7 | " | " | 90 | " | " |
| 3 | " | " | 15.4 | 15.4 | 0.45 | " | " | " | " | " | 100% | " | " |

TABLE 3-continued

| Test piece No. | Amount of chromium (as $CrO_3$) Cr (III) g/l | Cr (VI) g/l | Acrylic acid polymer (as solids) g/l | Silica*1 g/l | Ratio of silica*5 | Fluorine ion (as $F^-$) g/l | Ortho-phosphoric acid (as $PO_4^{-3}$) g/l | pH of bath | Affinity for water: Before test*2 | After 16 hours' standing*3 | After 96 hours' standing*3 | Test under humid atmosphere*4: After 250 hours' standing | After 500 hours' standing |
|---|---|---|---|---|---|---|---|---|---|---|---|---|---|
| 4 | 3.85 | 0 | 8 | 8 | 0.41 | " | 0 | 1.8 | " | 70 | 0 | " | 10 |
| 5 | 2.69 | 1.15 | " | " | 0.40 | " | 1.0 | 1.7 | " | 100 | 100 | " | 0 |
| 6 | 1.15 | 2.69 | " | " | 0.40 | " | " | " | " | 100 | 100 | " | " |
| 7 | 0 | 3.85 | " | " | 0.40 | " | 0 | " | " | 70 | 0 | " | " |
| 8 | 0.19 | 0.55 | " | " | 0.47 | " | 1.0 | 1.85 | " | 100 | 100 | 10% | 30% |
| 9 | 4.81 | 1.15 | " | " | 0.36 | " | " | 1.6 | " | 100 | 100 | 0% | 0% |
| 10 | 8.77 | " | " | " | 0.33 | " | " | 1.5 | " | 100 | 95 | " | " |
| 11 | 1.92 | 1.42 | " | " | 0.41 | 1.5 | " | 1.6 | " | " | 100 | " | " |
| 12 | " | " | " | " | " | 1.0 | 0 | 1.7 | " | 70 | 0 | " | " |
| 13 | " | " | " | " | " | 0.5 | 1.0 | 1.75 | " | " | 100 | " | 20% |
| 14 | " | " | " | " | " | 0 | " | 1.85 | " | — | — | — | — |
| 15 | " | " | 16.0 | 16.0 | 0.45 | 1.0 | 0 | 1.6 | " | 80 | 10 | 0% | 0% |
| 16 | 0 | 3.85 | " | " | " | 1.0 | 0 | 1.65 | " | 80 | 10 | " | " |

*1Silica - CAB-O-SIL (M5)
*2Water immersion method
*3Cooling-heating cycle method: One cycle (4 hours) consists of one hour's standing at −25° C., elevation of temperature up to 75° C. (over one hour's time), one hour's standing at 75° C., and lowering of temperature to −25° C. (over one hour's time). After this test, the test piece is subjected to the water-immersion method, followed by the measurement of the area of wet surface.
*4Area of corroded surface - The value "0%" denotes perfect absence of corrosion.
*5Ratio of silica - the weight ratio of silica to the total [acrylic acid polymer + chromium compounds (calculated as $CrO_3$) + silica]

TABLE 4

| Test piece No. | Hydrophilic treating bath (with addition of orthophosphoric acid): Amount of chromium (as $CrO_3$) Cr(III) g/l | Cr(VI) g/l | Acrylic acid polymer (as solids) g/l | Silica*1 (as solids) g/l | Fluorine ion g/l | Ortho-phosphoric acid g/l | pH of Bath | Ratio of silica | Affinity for water: Before test | After 16 hours' standing | After 96 hours' standing | Test under humid atmosphere (corroded area): 250 hrs. | 500 hrs. |
|---|---|---|---|---|---|---|---|---|---|---|---|---|---|
| 17 | 2.69 | 1.15 | 8 | 20 | 1.0 | 0 | 1.6 | 0.63% | 100% | 80% | 0% | 0% | 0% |
| 18 | " | " | " | " | " | 0.1 | 1.6 | " | " | 95 | 50% | " | 0% |
| 19 | " | " | " | " | " | 0.5 | 1.55 | " | " | 100 | 70 | " | 0% |
| 20 | " | " | " | " | " | 1.0 | 1.5 | " | " | 100 | 100 | " | 0% |
| 21 | " | " | " | " | " | 1.8 | 1.45 | " | " | " | " | " | 2% |
| 22 | " | " | " | " | " | 4.6 | 1.4 | " | " | " | " | " | 3% |
| 23 | " | " | " | " | " | 10 | 1.35 | " | " | " | " | " | 5% |
| 24 | " | " | " | " | " | 30 | 1.2 | " | " | " | " | " | 8% |
| 25 | " | " | " | " | " | 50 | 1.05 | " | " | " | " | " | 10% |
| 26 | " | " | " | " | " | 100 | 0.95 | " | " | " | " | " | 15% |

*1For silica SNOWTEX 20 (made by Nissan Chemical Industries, Ltd.) was used.

TABLE 5

| Test piece No. | Amount of chromium (as $CrO_3$) Cr(III) g/l | Cr(VI) g/l | Acrylic acid polymer (as solids) g/l | Silica (as solids) g/l | Fluorine ion (as $F^-$) g/l | | Ratio of silica | Affinity for water: Before test | After 16 hours' standing | After 96 hours' standing | Test under humid atmosphere: 250 hrs | 500 hrs | pH of bath |
|---|---|---|---|---|---|---|---|---|---|---|---|---|---|
| | | | | | | (In case of pyrophosphoric acid) Pyrophosphoric acid concentration (as $PO_4^{-3}$) g/l | | | | | | | |
| 27 | 2.69 | 1.15 | 8 | 20 | 1.0 | 0.1 | 0.63 | 100% | 70% | 0% | 0% | 0% | 1.55 |
| 28 | " | " | " | " | " | 1.0 | " | " | 97% | 50% | 0% | 0% | 1.5 |
| 29 | " | " | " | " | " | 10 | " | " | 100% | 100% | 0% | 0% | 1.2 |
| | | | | | | (In case of polyphosphoric acid) Polyphosphoric acid concentration g/l | | | | | | | |
| 30 | 2.69 | 1.15 | 8 | 20 | 1.0 | 0.1 | 0.63 | 100% | 66% | 0% | 0% | 0% | 1.55 |
| 31 | " | " | " | " | " | 1.0 | " | " | 88% | 25% | 0% | 8% | 1.45 |
| 32 | " | " | " | " | " | 10 | " | " | 100% | 100% | 0% | 0% | 1.05 |
| 33 | " | " | " | " | " | 50 | " | " | 100% | " | 0% | 0% | 0.9 |
| | | | | | | (In case of methaphosphoric acid) Methaphosphoric acid concentration | | | | | | | |

TABLE 5-continued

| Test piece No. | Amount of chromium (as $CrO_3$) Cr(III) g/l | Cr(VI) g/l | Acrylic acid polymer (as solids) g/l | Silica (as solids) g/l | Fluorine ion (as $F^-$) g/l | | Ratio of silica | Affinity for water: Before test | After 16 hours' standing | After 96 hours' standing | Test under humid atmosphere: 250 hrs | 500 hrs | pH of bath |
|---|---|---|---|---|---|---|---|---|---|---|---|---|---|
| | | | | | | g/l | | | | | | | |
| 34 | 2.69 | 1.15 | 8 | 20 | 1.0 | 0.1 | 0.63 | 100% | 100% | 29% | 0% | 0% | 1.55 |
| 35 | " | " | " | " | " | 1.0 | " | " | 100% | 25% | 0% | 0% | 1.5 |
| 36 | " | " | " | " | " | 10 | " | " | 100% | 100% | 0% | 0% | 1.4 |
| 37 | " | " | " | " | " | 50 | " | " | 100% | " | 0% | 0% | 1.35 |
| | | | | | | (In case of phosphorous acid) | | | | | | | |
| | | | | | | Phosphorous acid concentration g/l | | | | | | | |
| 38 | 2.69 | 1.15 | 8 | 20 | 1.0 | 0.1 | 0.63 | 100% | 90% | 40% | 0% | 0% | 1.5 |
| 39 | " | " | " | " | " | 1.0 | " | " | 96% | 48% | 0% | 0% | 1.45 |
| 40 | " | " | " | " | " | 10 | " | " | 100% | 100% | 0% | 0% | 1.15 |

TABLE 6

| Test piece No. | Amount of chromium (as $CrO_3$) Cr(III) g/l | Cr(VI) g/l | Acrylic acid polymer (as solids) g/l | Silica (as solids) g/l | Fluorine ion g/l | | pH of bath | Ratio of silica | Affinity for water: Before test | After 16 hours' standing | After 96 hours' standing | Test under humid atmosphere: 250 hrs | 500 hrs |
|---|---|---|---|---|---|---|---|---|---|---|---|---|---|
| | | | | | | (In case of monosodium phosphate) | | | | | | | |
| | | | | | | Monosodium phosphate concentration g/l | | | | | | | |
| 41 | 2.69 | 1.15 | 8 | 20 | 1.0 | 0.1 | 1.55 | 0.63 | 100% | 90% | 29% | 0% | 0% |
| 42 | " | " | " | " | " | 1.0 | 1.65 | " | " | 96% | 50% | 0% | 0% |
| 43 | " | " | " | " | " | 5 | 2.0 | " | " | 100% | 100% | obverse: 10%* reverse: 0% | obverse: 100%* reverse: 30% |
| 44 | " | " | " | " | " | 10 | 2.25 | " | " | 100% | 100% | obverse: 0%* reverse: 42% | obverse: 4%* reverse: 100% |
| *The corroded area in the obverse is different from that in the reverse. | | | | | | | | | | | | | |
| | | | | | | (In case of sodium pyrophosphate) | | | | | | | |
| | | | | | | Pyrophosphoric acid concentration g/l | | | | | | | |
| 45 | 2.69 | 1.15 | 8 | 20 | 1.0 | 0.1 | 1.55 | 0.63 | 100% | 100% | 75% | 0% | 0% |
| 46 | " | " | " | " | " | 1.0 | 1.8 | " | " | 100% | 83% | 0% | 0% |
| 47* | " | " | " | " | " | 5.0 | 1.5 | " | — | — | — | — | — |
| *The test was not performed because of production of precipitates | | | | | | | | | | | | | |
| | | | | | | (In case of sodium polyphosphate) | | | | | | | |
| | | | | | | Polyphosphoric acid concentration g/l | | | | | | | |
| 48 | 2.69 | 1.15 | 8 | 20 | 1.0 | 0.1 | 1.6 | 0.63 | 100% | 92% | 42% | 0% | 0% |
| 49 | " | " | " | " | " | 1.0 | 1.7 | " | " | 100% | 92% | 0% | 0% |
| 50 | " | " | " | " | " | 5 | 2.9 | " | " | 100% | 100% | 10% | 20% |
| | | | | | | (In case of sodium hexamethaphosphate) | | | | | | | |
| | | | | | | Hexamethaphosphoric acid concentration g/l | | | | | | | |
| 51 | 2.69 | 1.15 | 8 | 20 | 1.0 | 0.1 | 1.6 | 0.63 | 100% | 80% | 0% | 0% | 0% |
| 52* | " | " | " | " | " | 1.0 | 1.55 | " | — | — | — | — | — |

*The test was not performed because of production of precipitates.

What is claimed is:

1. A hydrophilic surface-treating process for an aluminum article comprising steps of applying to the surface thereof an aqueous hydrophilic surface-treating bath which consists essentially of 1 to 20 g, as $CrO_3$, of a mixture of trivalent and hexavalent chromium compounds, of which 0.05 to 2 g, as $CrO_3$, is a hexavalent chromium compound, 1 to 20 g, as solids, of a water-soluble acrylic acid polymer, 0.1 to 5 g, as $F^-$, of a fluoride, and 1 to 100 g of silica, respectively per liter of said bath, and the balance water, the weight ratio of said silica to the total weight of said acrylic acid polymer, said chromium compounds (calculated as $CrO_3$) and said silica being between 0.3:1 and 0.8:1; drying the thus-treated surface and heating the same at 100° C. to 250° C. for a period of 10 seconds to 30 minutes.

2. A hydrophilc surface-treating process as in claim 1 containing at least 0.1 g, as $PO_4^{-3}$, of phosphoric acid per liter of said bath.

3. The hydrophilic surface-treating process as claimed in claim 1, wherein said metal is in the form of an elongated strip passed continuously through said bath.

4. The hydrophilic surface-treating process for an aluminum article as claimed in claim 1, wherein said metal is in the form of discrete pieces and said pieces are immersed in said bath.

5. The hydrophilic surface-treating process for an aluminum article as claimed in claim 1, wherein said surface-treating agent is applied to the metal surface by spreading with a roll.

6. The hydrophilic surface-treating process for an aluminum article as claimed in claim 1, wherein said surface-treating agent is applied to the metal surface by spreading with a brush.

7. The hydrophilic surface-treating process for an aluminum article as claimed in claim 1, wherein said surface-treating agent is applied to the metal surface by immersion.

8. The hydrophilic surface-treating process for an aluminum article as claimed in claim 1, wherein said surface-treating agent is applied to the metal surface by spraying.

9. The hydrophilic surface-treating process for an aluminum article as claimed in claim 1, wherein said surface-treating agent is applied to the metal surface in a ratio of 20 to 40 $ml/m^2$.

10. The hydrophilic surface-treating process for an aluminum article as claimed in claim 1, wherein said surface-treating agent contains 2.5 to 12 g/l, as $CrO_3$, of said mixture of trivalent and hexavalent chromium compounds, of which 0.2 to 1.5 g/l, as $CrO_3$, is a hexavalent chromium compound, 4 to 14 g/l, as solid, of acrylic acid polymer, 0.3 to 3.5 g/l, as $F^-$, of a fluoride, and 5 to 30 g/l of silica, the weight ratio of said silica to the total weight of said acrylic acid polymer, said chromium compounds (calculated as $CrO_3$) and said silica being 0.35:0.65.

11. The hydrophilic surface-treating process for an aluminum article as claimed in claim 2, wherein said phosphoric acid is orthophosphoric acid present in an amount of 0.5 to 10 g/l, as $PO_4^{-3}$.

12. The hydrophilic surface-treating process for an aluminum article as claimed in claim 2, wherein said phosphoric acid is pyrophosphoric acid, polyphosphoric acid, metaphosphoric acid or phosphorous acid, and is present in an amount of 5 to 10 g/l, as $PO_4^{-3}$.

* * * * *